US009177744B2

(12) United States Patent
Biessenberger et al.

(10) Patent No.: US 9,177,744 B2
(45) Date of Patent: Nov. 3, 2015

(54) SWITCHING RELAY HAVING CONTACT RIPPING DEVICE

(75) Inventors: Thomas Biessenberger, Schorndorf (DE); Hartmut Wanner, Herrenberg-Oberjesingen (DE); Oliver Neumann, Heibronn (DE); Uwe von Ehrenwall, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 841 days.

(21) Appl. No.: 13/386,241

(22) PCT Filed: Jul. 20, 2010

(86) PCT No.: PCT/EP2010/060490

§ 371 (c)(1),
(2), (4) Date: Mar. 6, 2012

(87) PCT Pub. No.: WO2011/009865

PCT Pub. Date: Jan. 27, 2011

(65) Prior Publication Data

US 2012/0180745 A1 Jul. 19, 2012

(30) Foreign Application Priority Data

Jul. 20, 2009 (DE) ..... 10 2009 027 844

(51) Int. Cl.
*H01H 67/02* (2006.01)
*H01H 51/06* (2006.01)
*H01H 1/20* (2006.01)

(52) U.S. Cl.
CPC ..... *H01H 51/065* (2013.01); *H01H 1/2083* (2013.01); *Y10T 29/49105* (2015.01)

(58) Field of Classification Search
CPC ..... H01H 50/64; H01H 9/20; H01H 11/00; H01H 67/02
USPC ..... 335/131
See application file for complete search history.

(56) References Cited

U.S. PATENT DOCUMENTS 4,243,964 A * 1/1981 Bogner et al. ..... 335/156
4,604,597 A * 8/1986 Bogner et al. ..... 335/127
4,674,344 A * 6/1987 Kazino et al. ..... 74/7 A (Continued)

FOREIGN PATENT DOCUMENTS

DE 6751537 1/1969
DE 19814504 6/1999
DE 10260843 7/2004

OTHER PUBLICATIONS

PCT/EP2010/060490 International Search Report dated Nov. 2, 2010 (4 pages).

*Primary Examiner* — Shawki S Ismail
*Assistant Examiner* — Lisa Homza
(74) *Attorney, Agent, or Firm* — Michael Best & Friedrich LLP

(57) ABSTRACT

The invention relates to a switching relay (1), particularly for a starting device for starting an internal combustion engine, having a contact device (5), a relay coil (2), an armature (3), and an actuating rod (4), wherein the actuating rod (4) is displaced by the armature (3) when current is applied to the relay coil (2) and the contact device (5) is actuated by the actuating rod (4), and having a contact ripping device by means of which the armature (3) and the actuating rod (4) are coupled to each other. In order to simplify assembly and disassembly, the contact ripping device is implemented having a latching device in the armature (3).

11 Claims, 2 Drawing Sheets

(56) References Cited

U.S. PATENT DOCUMENTS

| | | | | | |
|---|---|---|---|---|---|
| 4,755,781 | A | * | 7/1988 | Bogner | 335/131 |
| 4,887,056 | A | * | 12/1989 | Kajino et al. | 335/126 |
| 4,987,396 | A | * | 1/1991 | Bogner | 335/126 |
| 5,059,935 | A | * | 10/1991 | Ohsawa et al. | 335/282 |
| 5,175,524 | A | * | 12/1992 | Gotoh | 335/126 |
| 5,222,401 | A | * | 6/1993 | Fasola et al. | 74/7 A |
| 5,424,700 | A | * | 6/1995 | Santarelli | 335/126 |
| 5,656,981 | A | * | 8/1997 | Niimi et al. | 335/126 |
| 5,677,656 | A | * | 10/1997 | Mauch et al. | 335/126 |
| 5,892,422 | A | * | 4/1999 | Montaigu et al. | 335/126 |
| 5,901,604 | A | * | 5/1999 | Sato et al. | 74/7 A |
| 6,552,638 | B2 | | 4/2003 | Rhodes | |
| 6,693,503 | B1 | * | 2/2004 | Nguyen et al. | 335/131 |
| 6,762,663 | B2 | * | 7/2004 | Andoh et al. | 335/126 |
| 6,937,123 | B2 | * | 8/2005 | Imanishi et al. | 335/126 |
| 7,038,564 | B1 | * | 5/2006 | Kusumoto et al. | 335/126 |
| 7,712,453 | B2 | * | 5/2010 | Nonoyama et al. | 123/458 |
| 8,125,303 | B2 | * | 2/2012 | Klingel et al. | 335/126 |
| 8,451,079 | B2 | * | 5/2013 | Niimi | 335/126 |
| 8,514,038 | B2 | * | 8/2013 | Weigt et al. | 335/126 |
| 2002/0005771 | A1 | * | 1/2002 | Rhodes | 335/126 |
| 2012/0180745 | A1 | * | 7/2012 | Biessenberger et al. | 123/179.25 |

* cited by examiner

SWITCHING RELAY HAVING CONTACT RIPPING DEVICE

BACKGROUND OF THE INVENTION

The invention relates to a switching relay, in particular for a starting apparatus for starting an internal combustion engine, having a contact device, a relay coil, an armature, an actuating rod, with the actuating rod being moved by the armature when current is supplied to the relay coil and the contact device being operated by means of the actuating rod, and having a contact breaking device by means of which the armature and the actuating rod are coupled to one another.

The invention also relates to a starting apparatus having a switching relay of this kind, and also to a mounting method and a removal method for a switching relay of this kind.

A starter motor of the starting apparatus is switched on and switched off by the switching relay. It is known in a switching relay to move the actuating rod with the armature by supplying current to the relay coil and to operate the contact device by means of the actuating rod.

Interruptions or other disturbances in the current supply when current is being supplied to the relay coil can lead to so-called fluttering contacts on the contact device, with the result that at least two contacts which adjoin one another establish a mutual connection, that is to say, as it were, stick to one another. This connection, which is created by a flow of current during fluttering, is called contact welding in the text which follows. In the case of a switching relay without a contact breaking device, the armature, on account of the lack of coupling between the armature and the actuating rod, returns to its inoperative position after the supply of current to the relay coil is switched off, but with the contact device then being operated, that is to say the contacts remaining closed, since the second spring cannot separate the contacts which are stuck to one another, that is to say cannot break the contact weld, since it does not apply a corresponding contact breaking force. Therefore, the switching function of a switching relay without a contact breaking device is disturbed after a contact welding operation. Current continues to be supplied to the starter motor or is supplied for longer, this leading to damage to the starting apparatus, to overheating, in particular to a cable fire, or to destruction of the starter motor if a vehicle battery as a power source is not disconnected in good time.

The risk is reduced with known contact breaking devices which apply a contact breaking force to the actuating rod when the relay is switched off in case a contact welding operation occurs.

DE 199 51 116 A1 describes a switching relay for a starting apparatus, with a coupling element being provided in order to carry along the actuating rod with a limited movement when the armature is moved backward only when a contact welding operation, which occurs under unfavorable conditions, occurs, and therefore the contact weld is broken by a return force of the armature.

U.S. Pat. No. 6,552,638 B2 describes a relay having a spring-assisted armature in which an actuating rod with a head is mounted. The actuating rod is moved axially by the armature against a spring force for closing a contact bridge when current is supplied. In order to break the contact bridge, in addition to the spring force, the head of the actuating rod is pulled along by a shoulder as a mating bearing into the guide in the armature in the event of a contact weld.

DE 102 60 843 A1 (D1) describes a relay, in particular a switching relay for a starter in one particular embodiment. In order to break adhesively bonded or welded contacts, a sufficient amount of kinetic energy is built up by pulsed acceleration of the magnet armature over a distance of the erosion reserve, and therefore an actuating rod is pulled back into the starting position by means of a head part when the head part runs through a distance b) in an annular groove. A relay coil is included in a housing which holds the magnet armature together in a pot-like manner.

DE 67 51 537 U (D3) describes an electromagnetic switch for starter motors of internal combustion engines. The armature has a longitudinal hole in which a bolt is secured by means of a semicircular groove in a bead in the longitudinal hole. From a mounting point of view, provision is made here to first connect the bolt to the armature in an interlocking manner, in order to then secure the bolt in the contact apparatus.

The object of the invention is to develop a switching relay of the type mentioned in the introductory part and a mounting and removal method for a switching relay of this kind in such a way that mounting and removal are simplified and the design of the switching relay is simplified.

SUMMARY OF THE INVENTION

The object is achieved by a switching relay in that the armature is in the form of part of an unlatchable latching apparatus for the contact breaking device, and the relay coil and the contact device are formed such that they can be pushed onto the armature as an assembly.

The armature is preferably prestressed with a first spring, and therefore it is deflected by means of the actuating rod being acted on when current is supplied to the relay coil for operating a contact device, and is moved back to an inoperative position by the spring after the supply of current is switched off. Moreover, the actuating rod can be prestressed by a second spring in order to move it to an inoperative position for opening the contact device or to keep it in this inoperative position as soon as it is no longer acted on by the armature.

In a preferred embodiment, the switching shaft is not fixedly coupled to the armature in respect of an, in particular axial, movement which opens the switching relay. If current is no longer applied to the relay coil, the armature and, decoupled from this, the actuating rod are in each case moved to their inoperative positions, specifically for opening the contact device, by the first and, respectively, the second spring and held there.

The contact device preferably comprises at least one contact plate with at least two electrical contacts which are secured, in particular, on the end face of the actuating rod. Therefore, the contact plate can be moved in order to close and open the contacts by virtue of an axial movement of the actuating rod.

The actuating rod can preferably be latched into the armature with play, which is axial in particular in the current-free state, of the relay coil, and therefore the armature and the actuating rod are coupled to one another over a certain distance, in an, in particular axially, moveable or mutually displaceable and simultaneous manner. Therefore, the armature can, as will be explained later, build up a pulse for the contact breaking device.

The object is also achieved by a mounting method in which the relay coil and the contact device are pushed onto the armature as an assembly and the actuating rod is partially pushed into the armature by way of its end which is opposite the contact device and is latched into said armature such that it can be unlatched. Therefore, mounting can be simplified, in particular in relation to cited document U.S. Pat. No. 6,552,638 B2, since the actuating rod does not have to be completely routed through the armature.

The object is further achieved by a removal method in which the actuating rod is withdrawn from the armature in the direction of the contact device, with said actuating rod being unlatched with an unlatching force, which exceeds a contact breaking force, for unlatching a latching apparatus which is part of the armature, and being withdrawn, and the relay coil and the contact device being removed from the armature as an assembly.

On account of the mounting method according to the invention, the armature and the actuating rod can be mounted and removed with the same movements with which they are also moved during operation of the switching relay, and therefore the mutual mounting of said armature and actuating rod can also be carried out in their installation position, it being possible to both mount and remove the actuating rod when an armature is already mounted and also to mount and remove the armature when an actuating rod is already mounted. This avoids, in particular, the complicated process of completely routing the actuating rod through the armature or an additional coupling element, as described in the prior art. Therefore, one advantage is complete mounting which can be executed in the conventional manner without substantial changes in the mounting sequence. In addition, the removal method according to the invention permits the armature and actuating rod to be separated without destruction and by an intuitive movement, specifically by simply pulling them apart with a single hand movement.

The switching relay is preferably composed of, preferably two, assemblies, with the actuating rod and the armature being associated with two different assemblies which are mounted relative to one another by the actuating rod being only partially axially pushed and latched into the armature.

Particularly in order to easily remove two such assemblies, the actuating rod can be unlatched from the armature with the unlatching force which is greater than the contact breaking force.

In a preferred embodiment, a housing component, the relay coil, the actuating rod and at least one contact plate with at least two contacts are premounted as an assembly and this assembly is pushed onto the armature with the actuating rod and latched in.

The latching apparatus preferably comprises a shoulder and an interengaging mating bearing as a bearing. The latching apparatus is, in particular, formed by a corresponding shape of the armature and/or of the actuating rod. The armature and the actuating rod can therefore latch directly into one another by virtue of a mutual interlocking connection and are particularly easy to mount since a further component, for example a coupling element according to the prior art which has to be connected both to the armature and to the actuating rod as a latching apparatus is advantageously avoided.

A bearing and a mating bearing can be both a constituent part of the contact breaking device and of the latching apparatus, with the two functions, specifically that of the contact breaking device and of the latching apparatus, being preferably realized by different forces, which are described above and below, on the same bearing or mating bearing. Therefore, the outlay on production and mounting is reduced.

The actuating rod preferably has at least one latching lug as the mating bearing and the armature preferably has at least one shoulder as the bearing, with the shoulder forming a stop face, in particular for an end face of a limb end of the latching lug. The armature and the at least one latching lug of the actuating rod can then be assembled by simply being pushed together by the latching lug being moved over the shoulder with a certain latching-in force.

In a preferred embodiment, the armature and the actuating rod can also be separated from one another by being pulled apart, with the latching lug being moved over the shoulder with an unlatching force in the opposite direction for this removal process. In the latched-in state, the shoulder therefore forms the stop face for the latching lug, it being possible for this mutual stop to be overcome preferably only with a defined unlatching force.

The latching apparatus can therefore also be formed such that its parts which are associated with the actuating rod in this description are associated with the armature, and vice versa. In particular, the bearing, in particular the shoulder, can therefore be formed on the actuating rod and the mating bearing, in particular the latching lug, can be formed on the armature.

Moreover, the latching apparatus can also have a plurality of, preferably two, three or four, latching lugs and a band as a shoulder. The latching apparatus can likewise be realized by both the armature and the actuating rod each having at least one shoulder and at least one latching lug.

The bearing, in particular the shoulder, is preferably produced from elastic material, and therefore a suitable unlatching force is determined, with which unlatching force the bearing is elastically deformed such that the mating bearing, in particular the latching lug, is released during removal, that is to say simple unlatching is made possible.

In addition, but preferably as an alternative thereto, the mating bearing, in particular the latching lug, is elastic and the latching apparatus can, in particular, be latched in and also unlatched by elastic deformation of the mating bearing, in particular of the latching lug.

In this case, the stop face of the shoulder and the end face of the latching lug are particularly preferably formed in an inclined manner with respect to the axial direction, in particular at a specific angle, for removing the actuating rod and the armature by unlatching. On account of the inclined design of these faces, the faces act like an inclined plane, that is to say, as it were, with a wedge effect or else as a ramp, in the event of the pulling-apart process, that is to say in the event of a force in an axial direction, and therefore a resulting force causes the latching lug and the shoulder to ultimately be routed past one another, specifically preferably by the latching lug being compressed by the shoulder, for unlatching purposes, and therefore the armature and actuating rod being separated from one another. In this case, the angle can be suitably selected in order to control the unlatching force.

In addition, the shoulder and/or the latching lug can each have a second face which is arranged in an inclined manner in relation to the axial direction, said second faces being designed to route the latching lug past the shoulder with a low expenditure of force when the actuating rod and the armature are latched in. These faces then likewise act, as described above, like an inclined plane, that is to say, as it were, with a wedge effect or else as a ramp.

In an embodiment which develops the invention, the latching apparatus comprises a spacer bushing with at least one latching lug. A spacer bushing of this kind can be a constituent part of the actuating rod and allows the use of different materials for the latching apparatus and the other constituent parts of the actuating rod, for example in order to realize said elasticity of the latching lug or to increase the service life. In addition, mounting of the switching relay is simplified as a result since the latching apparatus, at least the latching lug with the spacer bushing, is premounted on the actuating rod.

In particular, the latching apparatus, in particular the mating bearing, specifically preferably the spacer bushing, can be produced from plastic in order to design the switching relay in as economical and weight-saving manner as possible.

In order to produce a latching apparatus with a long service life, the latching apparatus, in particular the mating bearing, specifically preferably the spacer bushing, can be produced from a resilient, metal material, for example in order to form elastic latching lugs.

The object is also achieved by a starting apparatus for starting an internal combustion engine having a switching relay as described above or below.

It goes without saying that the features cited above and those still to be explained below can be used not only in the respectively specified combination but also in other combinations.

BRIEF DESCRIPTION OF THE DRAWINGS

The invention will be explained in greater detail below with reference to the drawings, in which.

DETAILED DESCRIPTION

Figure 1:
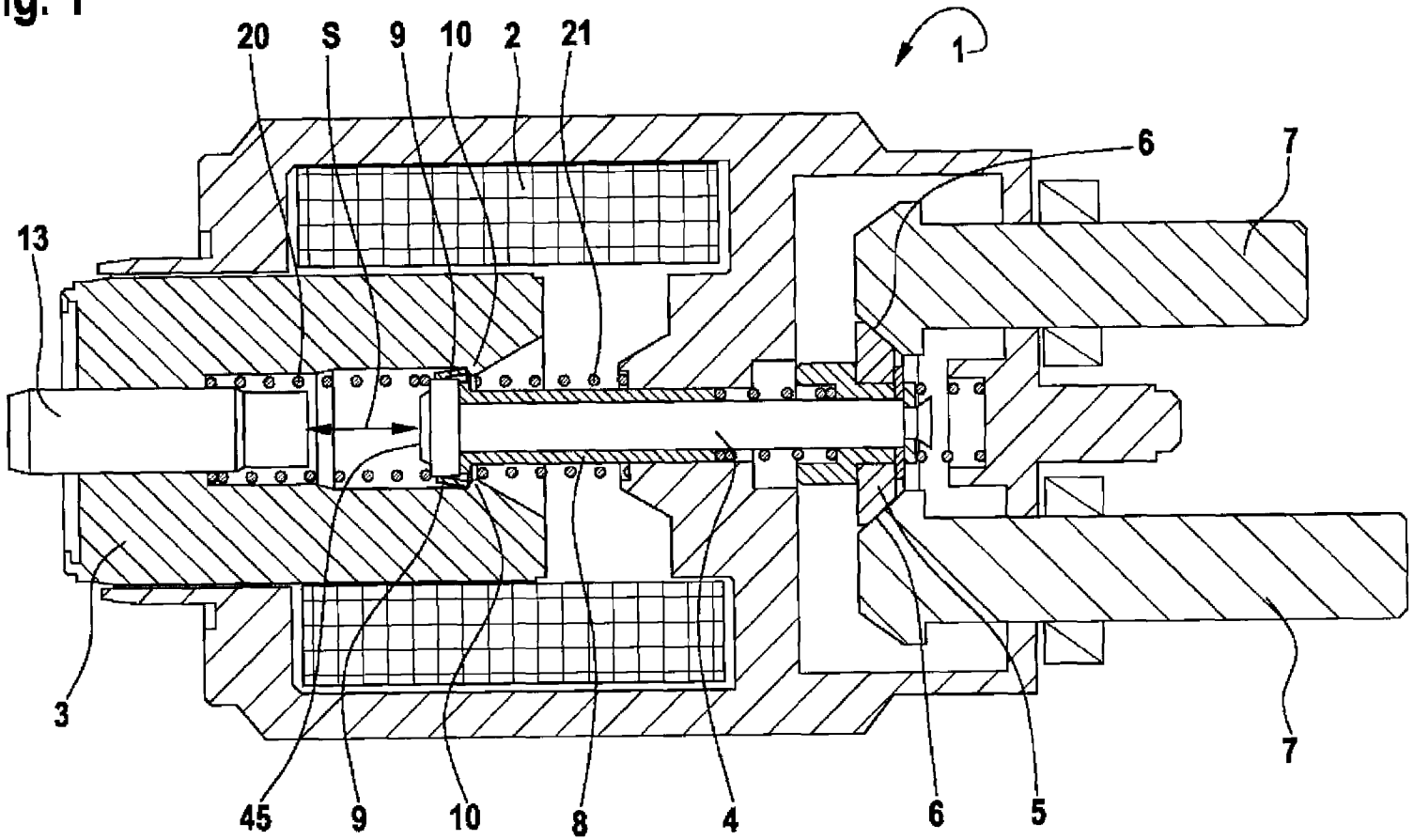
FIG. 1 shows a cross section through a switching relay according to the invention.
Figure 3:
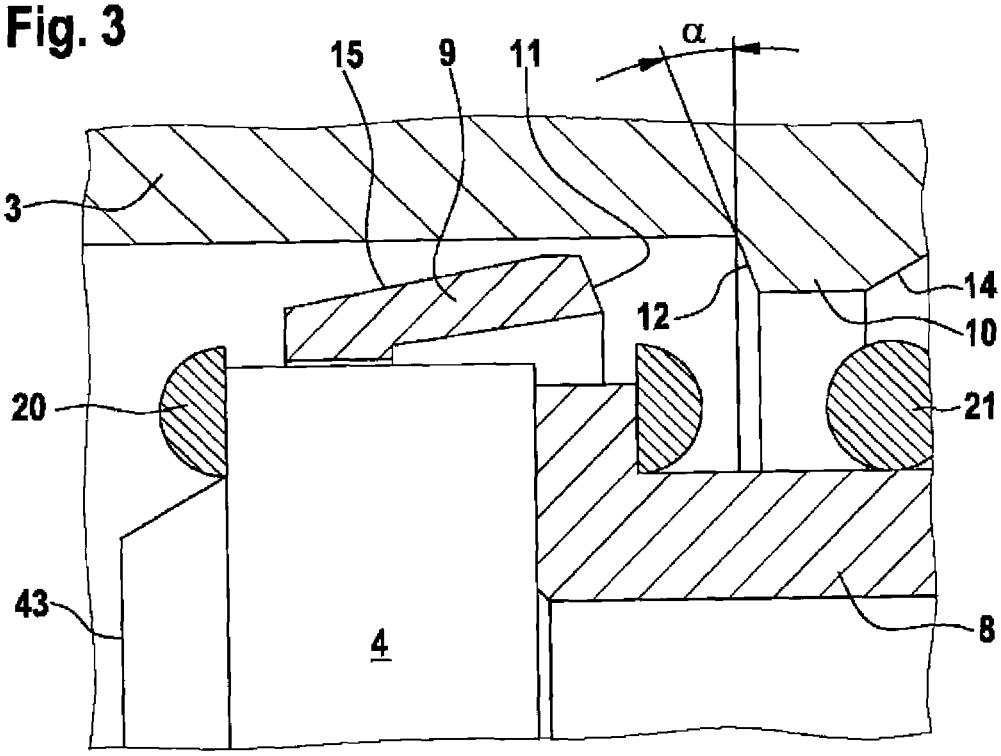
FIG. 3 shows a cross section through a latching apparatus according to the invention.

FIG. 1 shows a cross section through a switching relay 1 according to the invention for a starting apparatus for starting an internal combustion engine in a motor vehicle, which switching relay, as a starter relay with an armature 3, also engages a starter pinion (not illustrated) in a ring gear of the internal combustion engine. The switching relay 1 is formed with a relay coil 2, the armature 3 which is prestressed by a first spring 20, and an actuating rod 4 which is prestressed by a second spring 21 and is mounted coaxially in relation to the armature 3. In this case, the actuating rod 4 is coupled to the armature 3 by a latching apparatus, specifically not rigidly but such that it can be displaced in the axial direction, that is to say horizontally in FIG. 1, in relation to said armature. The latching apparatus which is illustrated in FIG. 3 comprises at least three latching lugs 9 of a spacer bushing 8 on the actuating rod 4 and a shoulder 10 on the armature 3. At its end which is opposite the armature 3, the actuating rod 4 has, as a contact device, a contact plate 5 with two contacts 6 for electrically connecting contact screws 7. Therefore, by virtue of an axial movement of the actuating rod 4, a current for a starter motor of the starting apparatus can be connected by the switching relay 1 via the contact screws 7. A pressure bolt 13 is centered on the armature 3 and reliably secured to an assembly with a forked lever of the starting apparatus. The rest of the switching relay 1 is only then mounted, with the latching lugs 9, of which only two are illustrated, on the spacer bushing 8 latching in with the shoulder 10 of the armature 3 in the axial opening with axial play.

In a switched-off state which is shown in FIG. 3, that is to say when no current is supplied to the relay coil 2, the armature 3 is in an inoperative position and the contacts 6 are open. In this case, the latching lugs 9 of the spacer bushing 8 do not bear against the shoulder 10 of the armature 3, and therefore the service life is increased.

In a switched-on state (not illustrated) of the switching relay 1, current is supplied to the relay coil 2 and the armature 3 moves into the relay coil 2, and therefore an end face of the pressure bolt 13, which is coaxially mounted in the armature 3, butts against a head 45 of the actuating rod 4 and closes the contact bridge with the contact plate 5 against the spring force. In this state, a current flows across the contact screws 7, which are connected to the contact plate 5, for operating the starter motor of the starting apparatus. In this state, the latching lugs 9 likewise do not bear axially against the shoulder 10 of the armature 3, and therefore the service life is increased.

FIG. 1 shows a state of the switching relay 1 with a so-called contact weld, in which state the contacts 6 are closed, that is to say the contact plate 5, as it were, sticks to the contact screws even though no current is supplied to the relay coil 2. The contact weld has occurred, for example, on account of a brief disturbance, specifically an interruption in the supply of current to the relay coil 2, and this led to fluttering of the contacts 6 on the contact plate 5. In addition, an increased number of cycles due to a start/stop operating function can lead to an increase in the temperature of the switching relay 1 overall, and therefore the occurrence of contact welds is promoted.

In this case, FIG. 1 shows the switching relay 1 at a time at which a contact breaking device acts on the contact weld. The contact breaking device comprises, like the latching apparatus, substantially the shoulder 10 on the armature 3 and the spacer bushing 8 with the latching lugs 9 on the actuating rod 4. In this exemplary embodiment, the contact breaking device and the latching apparatus are therefore realized by a single structural arrangement. The spacer bushing 8 is produced from a resilient metal.

Figure 2:
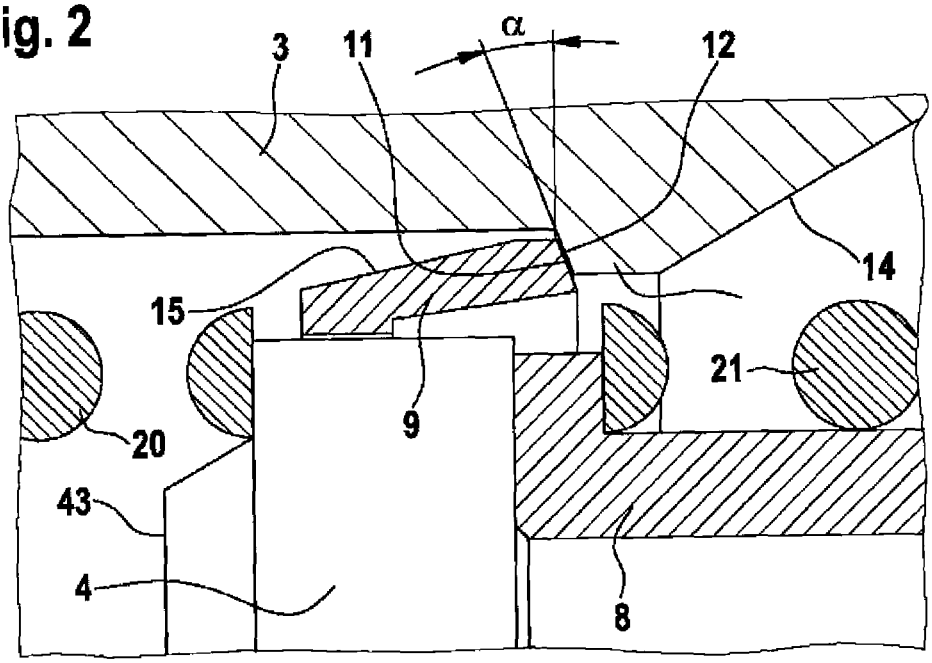
FIG. 2 shows an enlarged illustration of a detail of a contact breaking device shown in FIG. 1.

FIG. 2 shows an enlarged illustration of a detail of the cross section shown in FIG. 1 through the contact breaking device. After the supply of current to the relay coil 2 is switched off, the armature 3, in a manner driven by the first spring (not illustrated), moves away from the actuating rod 4 and toward its inoperative position, specifically to the left in FIGS. 1 and 2. If there were no contact welds, the actuating rod 4, in a manner driven by the second spring 21, would also move to its inoperative position, specifically likewise to the left in FIGS. 1 and 2, and therefore open the contacts 6. Therefore, in principle, the shoulder 10 and the latching lugs 9 do not make contact during normal operation. However, the spring force of the second spring 21 is not always high enough to apply a required high contact breaking force for breaking the contact weld which has occurred in the meantime.

Therefore, the contact breaking device operates as follows. The armature 3 moves, as mentioned above, out of the relay coil 2, which is no longer supplied with current, due to spring force and a lack of magnetic action. In the process, the armature 3 experiences acceleration with a certain mass M. Since the actuating rod 4 does not move back due to the contact weld, the armature 3 strikes the latching lugs 9 by way of the shoulder 10 and thus transmits the contact breaking force to the actuating rod 4 by a pulse, and therefore the contact weld is broken. The armature 3 travels a distance S in order to generate the pulse.

FIG. 3 shows a schematic cross section through the latching apparatus according to the invention shown in FIGS. 1 and 2 with the armature 3 and the actuating rod 4 each in their inoperative position with no current supplied to the relay coil 2 and with the contacts 6 open. The latching apparatus is both a constituent part of the armature 3 and of the actuating rod 4, with said latching apparatus comprising the shoulder 10 of the armature 3 and the latching lugs 9 on the actuating rod 4. Therefore, the latching apparatus simultaneously also represents the contact breaking device, these two being realized with the shoulder 10 and the spacer bushing 8 being realized with the latching lugs 9, and therefore simple mounting is achieved.

The shoulder 10 is produced by an undercut in an axial opening in the armature 3 and has a stop face 12 and a chamfer 14. The latching lugs 9 are formed on a spacer bushing 8, which is produced from plastic as an alternative, and each have an end face 11 at a limb end, with the end faces 11 and the stop face 12 being designed for the latching lugs 9 and the shoulder 10 to stop against one another in order both to latch in the actuating rod 4 and the armature 3 and to transmit the contact breaking force from the armature 3 to the actuating rod 4.

In order to mount the switching relay, in particular to assemble the actuating rod 4 with the armature 3, the actuating rod 4 is axially partially inserted into the armature 3 by way of its end, which has the head 45 and the spacer bushing 8, with the latching lugs each being pressed into the axial opening in the armature 3 past the shoulder 10 by the elastic latching lugs 9 being compressed with their conical face 15 by the shoulder 10 by virtue of a wedge effect of the inclined chamfer 14. After passing the shoulder 10, the latching lugs 9 return to their original shape on account of their elastic property, and therefore the actuating rod 4 latches into the armature 3 and the contact breaking device takes effect, when the armature is withdrawn, by the latching lugs 9 each butting against the stop face 12 of the shoulder 10 by way of their end faces 11. Therefore, the actuating rod 4 can be easily assembled with the armature 3 by simply latching into said armature. Therefore, there are two complete assemblies, specifically the armature 3 with the pressure bolt 13, and the prefabricated assembly of the starter relay 1 with the contact plate 5, as conventionally assembled in one step.

For removal purposes, the actuating rod 4 is withdrawn from the armature 3 in the direction of the contact plate 5, or the armature 3 is removed from the actuating rod 4 in the opposite direction, but with the end face 11 butting against the stop face 12. The two faces are inclined in relation to the axial direction, and therefore a wedge effect is produced between the elastic latching lugs 9 and the shoulder 10 and the latching lugs 9 are compressed when there is a high enough removal force, which is greater than the contact breaking force, as soon as the actuating rod 4 is acted on by a suitable unlatching force. Therefore, the actuating rod 4 can be removed from the armature 3 by virtue of a simple movement, specifically in particular without destruction, and therefore subsequent mounting without additional expenditure is possible.

Moreover, the unlatching force is structurally defined substantially by the elasticity of the latching lugs 9 and by the angle $\alpha$ of the end face 11 or of the stop face 12 in relation to the axial direction, specifically in particular such that the unlatching force exceeds the contact breaking force. This ensures that, in the event of contact welding, the contact breaking force is transmitted from the armature 3 to the actuating rod 4, without the latching apparatus unlatching in the process and at the same time, however, unlatching being possible in the event of removal, for example for servicing or for separating materials when disposing of the switching relay 1.

Overall, the following advantages are achieved by the switching relay 1 according to the invention, in particular in comparison to the prior art: the contact breaking device can be realized without an additional coupling element or further component and can be removed, in particular, without destruction and such that it can be mounted again. The latching apparatus according to the invention can be mounted with the spacer bushing 8 with latching lugs 9 without any substantial structural changes in conventional switching relays, in particular without changing the mounting steps and without changes in the relay coil 2, the spring forces, the contact plate 5 with the contacts 6 or the length of the armature 3 and of the actuating rod 4. Therefore, overall, a contact breaking device can be combined with the latching apparatus according to the invention in a cost-effective manner.

A further exemplary embodiment (not illustrated) represents a starting apparatus for starting an internal combustion engine in a motor vehicle having the switching relay which is illustrated in FIG. 1 to FIG. 3. All the figures show only schematic illustrations which are not drawn to scale. Moreover, reference is made, in particular, to the illustrations in the drawing as being essential to the invention.

The invention claimed is:

1. A switching relay (1) having a contact device (5), a relay coil (2), an armature (3), an actuating rod (4) moved by the armature (3) when current is supplied to the relay coil (2), the contact device (5) being operated by the actuating rod (4), and having a contact breaking device by which the armature (3) and the actuating rod (4) are coupled to one another, with the relay coil (2) and the contact device (5) being formed as an assembly, wherein the armature is in the form of part of an unlatching apparatus for the contact breaking device, and the assembly of the relay coil (2) and the contact device (5) are formed such that they are pushed into the armature; wherein the unlatching apparatus comprises a shoulder (10) and an interengaging mating bearing (9); wherein the actuating rod (4) has at least one latching lug (9) as the mating bearing (9) and the armature (3) has a shoulder (10), with the shoulder (10) forming a stop face (12) for an end face (11) of a limb end of the latching lug (9); and wherein the stop face (12) of the shoulder (10) and the end face (11) of the latching lug (9) are each formed in an inclined manner with respect to the axial direction at a specific angle ($\alpha$), for removing the actuating rod (4) from the armature (3).

2. The switching relay (1) as claimed in claim 1, wherein the actuating rod (4) is latched in the armature (3) with axial play in the current-free state of the relay coil (2).

3. The switching relay (1) as claimed in claim 1, wherein the actuating rod (4) and the armature (3) is unlatched with an unlatching force which is greater than a contact breaking force.

4. The switching relay (1) as claimed in claim 1, wherein the latching apparatus comprises a spacer bushing (8) with latching lugs (9).

5. The switching relay (1) as claimed in claim 4, wherein the latching apparatus, in particular the mating bearing (9), is produced at least partially from plastic.

6. The switching relay (1) as claimed in claim 4, wherein the latching apparatus, in particular the mating bearing (9), is produced at least partially from resilient metal material.

7. A starting apparatus for starting an internal combustion engine having a switching relay as claimed in claim 1.

8. A mounting method for a switching relay (1) having a contact device (5), a relay coil (2), an armature (3), an actuating rod (4), with the actuating rod (4) being moved by the armature (3) when current is supplied to the relay coil (2) and the contact device (5) being operated by the actuating rod (4), and having a contact breaking device by which the armature (3) and the actuating rod (4) are coupled to one another, with the relay coil (2) and the contact device (5) being formed as an assembly, wherein the assembly of the relay coil (2) and the contact device (5) are pushed into the armature and the actuating rod (4) is partially pushed into the armature (3) by way of its end which is opposite the contact device (5) and is latched into said armature such that it is unlatched; wherein the armature is in the form of part of an unlatching apparatus for the contact breaking device wherein the unlatching apparatus comprises a shoulder (10) and an interengaging mating bearing (9); wherein the actuating rod (4) has at least one latching lug (9) as the mating bearing (9) and the armature (3) has a shoulder (10), with the shoulder (10) forming a stop face (12) for an end face (11) of a limb end of the latching lug (9); and wherein the stop face (12) of the shoulder (10) and the end face (11) of the latching lug (9) are each formed in an inclined manner with respect to the axial direction at a specific angle ($\alpha$), for removing the actuating rod (4) from the armature (3).

9. The mounting method as claimed in claim 8, wherein the switching relay is part of a starting apparatus for starting an internal combustion engine.

10. A removal method for a switching relay (1) having a contact device (5), a relay coil (2), an armature (3), an actuating rod (4) moved by the armature (3) when current is supplied to the relay coil (2) and the contact device (5) being operated by the actuating rod (4), and having a contact breaking device by which the armature (3) and the actuating rod (4) are coupled to one another, with the relay coil (2) and the contact device (5) being formed as an assembly, wherein the actuating rod (4) is withdrawn from the armature (3) in the direction of the contact device (5), with said actuating rod being unlatched with an unlatching force, which exceeds a contact breaking force, for unlatching the armature (3) from the relay coil (2) and the contact device (5) assembly; wherein the armature is in the form of part of an unlatching apparatus for the contact breaking device wherein the unlatching apparatus comprises a shoulder (10) and an interengaging mating bearing (9); wherein the actuating rod (4) has at least one latching lug (9) as the mating bearing (9) and the armature (3) has a shoulder (10), with the shoulder (10) forming a stop face (12) for an end face (11) of a limb end of the latching lug (9); and wherein the stop face (12) of the shoulder (10) and the end face (11) of the latching lug (9) are each formed in an inclined manner with respect to the axial direction at a specific angle ($\alpha$), for removing the actuating rod (4) from the armature (3).

11. The removal method as claimed in claim 10, wherein the switching relay is part of a starting apparatus for starting an internal combustion engine.

* * * * *